US005573507A

United States Patent [19]

Moser et al.

[11] Patent Number: 5,573,507

[45] Date of Patent: Nov. 12, 1996

[54] MULTI-USE INFANT-FEEDING NIPPLE SYSTEM

[76] Inventors: Ramon Moser, 1110 Meadow Lake Way, Apt. #100, Winter Springs, Fla. 32708; Gustayo Moser, Lomas De La Lagunita Qta Guarandinga, Carncas, Venezuela

[21] Appl. No.: 399,539

[22] Filed: Mar. 7, 1995

Related U.S. Application Data

[63] Continuation-in-part of Ser. No. 774,732, Oct. 9, 1991, Pat. No. 5,395,322, which is a continuation of Ser. No. 494,962, Mar. 16, 1990, abandoned.

[51] Int. Cl.[6] ..... A61J 9/00

[52] U.S. Cl. ..... 604/77; 215/11.1

[58] Field of Search ..... 604/77, 79; 606/234–236; 215/1 A, 11.1, 11.4, 11; 224/148; 239/33

[56] References Cited

U.S. PATENT DOCUMENTS

| | | | |
|---|---|---|---|
| 42,427 | 4/1864 | Zeno | 215/11.1 |
| 102,417 | 4/1870 | Mason | 215/11.1 |
| 140,518 | 7/1873 | Mayall | 215/11.1 |
| 224,557 | 2/1880 | Potter | 215/11 |
| 323,597 | 8/1885 | Prime | 215/11.1 |
| 593,830 | 11/1897 | Borgenschild | 215/11 |
| 1,144,980 | 6/1915 | Hilton | 215/11 |
| 2,063,424 | 12/1936 | Ferguson | 128/252 |
| 2,760,664 | 8/1956 | D'Amico | 215/11.1 |
| 2,989,961 | 6/1961 | Blanchett | 215/11 |
| 3,065,873 | 11/1962 | Plate | 215/11.1 |
| 3,165,241 | 1/1965 | Curry | 222/490 X |
| 3,323,669 | 6/1967 | Yazaki | 215/11 |
| 3,426,755 | 2/1969 | Clegg | 604/77 |
| 3,718,140 | 2/1973 | Yamauchi | 604/77 |
| 3,990,596 | 11/1976 | Hoftman | 215/11 R |
| 4,301,934 | 11/1981 | Forestal | 215/11 D |
| 4,813,933 | 3/1989 | Turner | 604/79 |
| 4,898,290 | 2/1990 | Cueto | 215/11.1 |
| 5,060,833 | 10/1991 | Edison et al. | 224/148 |
| 5,105,956 | 4/1992 | Tarng-Lin | 215/11.1 |

*Primary Examiner*—Michael Powell Buiz
*Assistant Examiner*—Nancy Mulcare
*Attorney, Agent, or Firm*—Dennis H. Lambert

[57] ABSTRACT

A multi-use infant-feeding nipple system that enables an infant to drink liquid from various types of containers, including conventional baby bottles, cans, glasses, and the like. The nipple system includes a flexible, elastomeric nipple having a base end and a tip end. The base end includes a reduced diameter opening for sliding, sealed receipt of one end of a tubular conduit which may be extended at its other end into a container that need not be held in an elevated position in or in close proximity to the infant's mouth. The tip end has a normally closed slitted opening through which liquid is enabled to flow when the infant sucks on the nipple, and which closes when the infant ceases sucking, thereby functioning as a check valve and preventing ingress of air into the nipple and preventing the liquid from draining out of the nipple and any conduit attached to it. This, in turn, avoids ingestion of air when the infant resumes feeding.

17 Claims, 11 Drawing Sheets

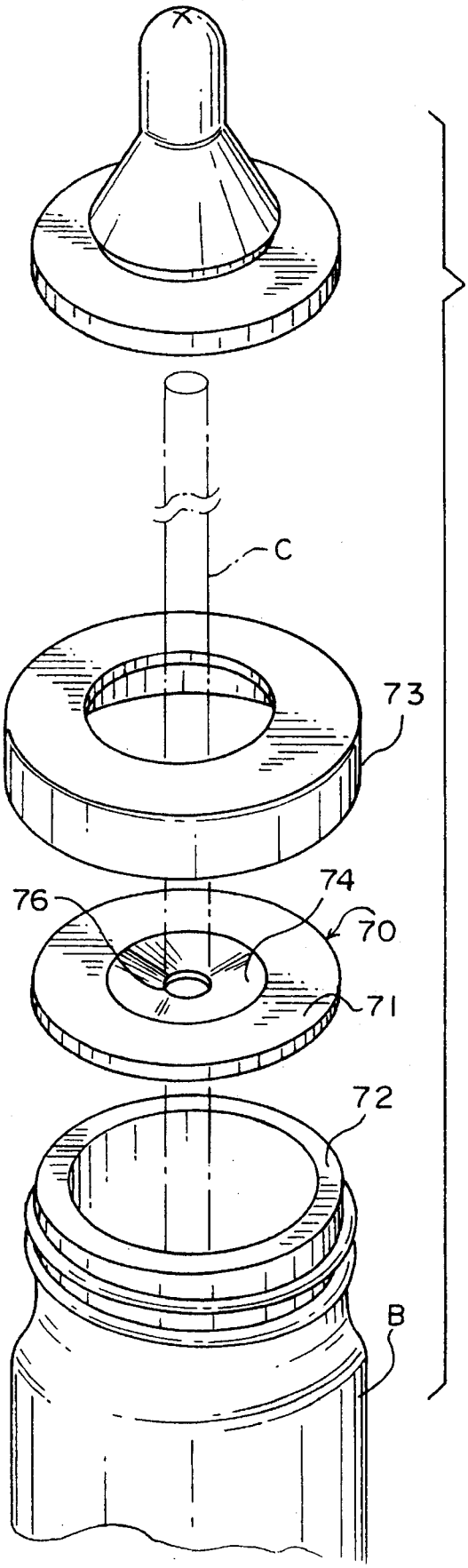
FIG. 12
FIG. 14
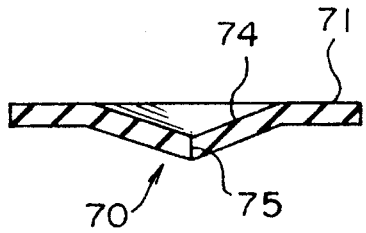
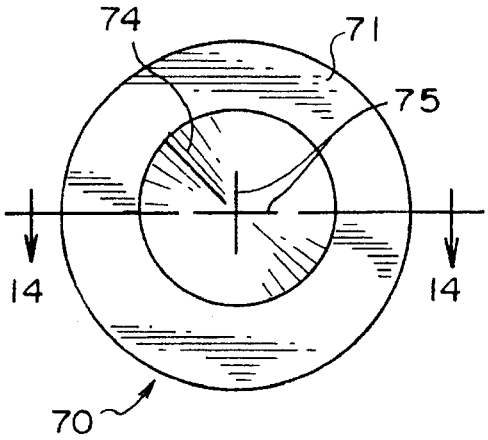
FIG. 13

MULTI-USE INFANT-FEEDING NIPPLE SYSTEM

This application is a Continuation-In-Part (CIP) of U.S. patent application Ser. No. 07/774,732, filed Oct. 9, 1991, now U.S. Pat. No. 5,395,322, entitled "Baby Feeding Nipple System" which is a continuation of application Ser. No. 07/494,962, filed Mar. 16, 1990 now abandoned, entitled "Baby-Feeding Nipple and Conduit System", now abandoned.

FIELD OF THE INVENTION

This invention relates to an infant-feeding nipple, and particularly to a multi-use infant-feeding nipple and system which enables an infant to drink liquid from various types of containers and from containers that need not be held in an elevated position in close proximity to the infant's mouth.

BACKGROUND OF THE INVENTION

There are many different types of infant-feeding nipples available on the market, most of which must be attached directly to the container or bottle which supplies the liquid to the infant. In these conventional arrangements, the bottle must be elevated above the infant's mouth so that the liquid contained therein fills the nipple attached to the bottle in order to enable the infant to suck on the nipple and draw liquid from the bottle. In order for the infant itself to hold the bottle in a properly elevated position, the infant must generally have reached a certain stage of development and maturity. Moreover, the infant must generally be in a reclining position in order to properly orient the bottle for drinking from it. With such conventional systems, it is not uncommon for the bottle to be lowered from the properly elevated position, permitting the liquid to flow out of the nipple back into the bottle and resulting in the infant ingesting air when an effort is next made to drink from the bottle. This can lead to discomfort and/or frustration of the infant. Moreover, the necessity for holding a conventional bottle in an elevated position in close proximity to the infant's face prevents the infant from engaging in other activities or play while feeding, or requires the assistance of a parent or other attendant, or requires "propping" of the bottle to enable the infant to drink from the bottle while lying down.

Some specially constructed infant-feeding nipple systems have been developed in the prior art which enable an elongate conduit to be attached to the nipple at one end and to a container of liquid at the other end so that the infant can drink liquid from the container without holding the container in an elevated position in close proximity to the infant's face. However, such prior art systems are either relatively complex and expensive in construction, or are limited in their versatility of use. Moreover, such conventional systems may be difficult to clean and/or sterilize following use, and they do not include check valve means to prevent ingress of air into the nipple and conduit when sucking action ceases, whereby the liquid is enabled to flow out of the nipple and conduit, resulting in loss of prime of liquid in the nipple and conduit and ingestion of air by the infant when feeding is resumed.

Sometimes it may be desirable for a parent or other attendant to hold the infant while the infant is feeding, and in these circumstances a bottle may be held by the parent or the other attendant in a properly elevated position in close proximity to the infant's mouth. The parent or other attendant can ensure that the bottle is maintained in the proper position to avoid ingestion of air by the infant, which can otherwise lead to discomfort or frustration of the infant. At other times, however, it may not be convenient or even possible for a parent or other attendant to hold a bottle in a normal, properly elevated position for feeding the infant, and in these circumstances an infant-feeding system is required that does not necessitate holding the container of liquid in an elevated position in close proximity to the infant's mouth. This may occur, for example, when only one parent or other attendant is in company with the infant and is not able to hold the infant and/or the bottle in proper position for feeding in a conventional way, such as when the infant is secured in a car seat and the parent or other attendant is occupied with driving a vehicle or is engaged in other activity.

There is thus need for an infant-feeding nipple system that can be used to feed an infant conventionally, i.e., with the bottle held in elevated position and in close proximity to the infant's mouth, or which can be used in a variety of ways to enable the infant to drink liquid from a bottle that may not be held in an elevated position or even in close proximity to the infant's mouth, or even to drink from a container other than a bottle, such as a carton, soft drink can, glass, or other container. Further, there is need for such a device which is simple and economical in construction and easy to clean and sterilize, and which maintains the liquid in the nipple when suction action ceases.

SUMMARY OF THE INVENTION

Therefore, it is an object of the present invention to provide an infant-feeding nipple system that overcomes the disadvantages of known systems.

Another object of the invention is to provide an infant-feeding nipple system that can be used in a variety of ways, including: drinking from a bottle held elevated in a conventional manner; drinking from a bottle that need not be elevated above the infant's mouth; drinking from a bottle that need not be elevated and may be located remote from the infant's mouth; and drinking from conventional containers such as glasses, cans, cartons, and the like.

A further object of the invention is to provide an infant-feeding nipple system that is inexpensive and simple in construction and which is easy to clean and sterilize following use.

A still further object of the invention is to provide an infant-feeding nipple that may be applied directly to a bottle and used like a conventional nipple, or which may have a conduit attached to it for enabling the infant to drink from a bottle that need not be elevated above the infant's mouth and may even be located remote from the infant, or to enable the infant to drink from conventional containers such as glasses, cans, cartons, and the like.

Yet another object of the invention is to provide an infant-feeding nipple system that can be applied directly to a bottle in the same way as a conventional nipple, or which can have a conduit attached to it to enable the nipple to be used with a container that is located remote from the nipple, and further, wherein the nipple is specially constructed to enable attachment to it of different diameter conduits.

A still further object of the invention is to provide an infant-feeding nipple system that may be attached directly to a bottle in an conventional way, and which has a specially configured base construction that enables a conduit to be attached to it for extending into the bottle, and wherein the conduit is connected to the nipple such that the conduit is pivotable about its connection with the nipple, so that it can follow the lowest point of the bottle or container, thereby ensuring that the conduit remains immersed in the liquid in the bottle or other container.

Another object of the invention is to provide an infant-feeding nipple in which an opening in the tip end for flow of liquid from the nipple functions as a check valve when sucking ceases, to prevent ingress of air into the nipple and thereby maintain liquid in the nipple so that the infant does not ingest air when feeding resumes.

In order to meet the foregoing as well as other objects of the invention, a preferred form of nipple in accordance with the invention has a specially constructed base that enables it to be attached directly to a bottle in a conventional way, and which also has means for attachment to it of a conduit to enable the nipple to be used with a bottle that need not be elevated above the infant's mouth, and even to enable use of the nipple with containers such as glasses, cans, cartons, and the like. In this preferred embodiment of the invention, the base has a rigid, enlarged diameter ring that serves as a flange for securing the nipple to a bottle, and which also provides an enlarged, rigid structure that prevents the infant from accidentally swallowing the nipple. A reduced diameter opening is formed in the base end of the nipple for receiving a conduit when it is desired to use the nipple in other than a conventional way, and this reduced diameter opening may be tapered to accommodate conduits of different diameter. Further, the tapered opening supports the conduit in such a way that when the nipple and conduit are applied directly to a bottle, the lower or inlet end of the conduit is permitted to pivot about its connection with the nipple, so that it can follow the lowest portion of the bottle or other container, thereby ensuring that the inlet end of the conduit remains immersed in the liquid in the bottle.

In another form of the invention, the nipple is not constructed for attachment directly to a container, but has a reduced diameter opening in its base end for attachment of a conduit so that the nipple may be used to permit an infant to drink from a container that need not be held in elevated position or in close proximity to the infant's mouth. A separate rigid ring member is attached to the base end of the nipple for creating a pacifier-like structure that prevents the infant from inadvertently swallowing the nipple, and also reinforces the reduced diameter base end of the nipple to enable it to securely grip a conduit inserted therein.

In all forms of the invention, the nipple has a slitted outlet opening in its tip end through which the infant draws liquid from the nipple, and this slitted opening functions as a check valve to prevent ingress of air into the nipple through the slitted opening when the bottle is moved from its elevated position and sucking action ceases. This check valve function of the slitted opening in the nipple maintains liquid in the nipple after it has been filled with liquid, thereby ensuring that the liquid will be immediately available to the infant when sucking is resumed. Consequently, the nipple of the invention not only is capable of use in a variety of ways, but also maintains liquid in the nipple at all times and prevents ingestion of air by the infant or frustration due to interrupted feeding when the infant has stopped feeding for a period of time and then resumes feeding. With conventional nipple systems, air flows into the nipple when the infant ceases feeding and the container is lower than the nipple, resulting in loss of prime of liquid in the nipple and subsequent ingestion of air when the infant attempts to resume feeding.

BRIEF DESCRIPTION OF THE DRAWINGS

The foregoing as well as other objects and advantages of the invention will become apparent from the following detailed description when considered in conjunction with the accompanying drawings, wherein like reference characters designate like parts throughout the several views, and wherein:

FIG. 12 is an exploded perspective view of an infant feeding nipple system according to the invention, wherein a first form of substantially flat, disc-like ring member or adaptor is used to attach a conduit to a bottle, and the conduit is connected at its distal end to one of the forms of nipple described herein;

FIG. 13 is a plan view of a second form of adaptor, wherein slits are provided rather than the opening of FIG. 12;

FIG. 14 is a transverse sectional view of the ring member of FIG. 13, and is taken along line 14—14 in FIG. 13;

FIG. 17 is a somewhat schematic perspective view showing how any one of the nipples of FIGS. 1 through 12 may be attached to a conventional soda straw or other tubular conduit to enable an infant to drink liquid from a carton containing fruit juice or the like;

FIG. 28 is a perspective view of the nipple and conduit of FIGS. 25 and 26, showing how the nipple and conduit system may be used to drink from a container such as a can or the like.

DETAILED DESCRIPTION OF THE PREFERRED EMBODIMENTS

Figures 1, 2:
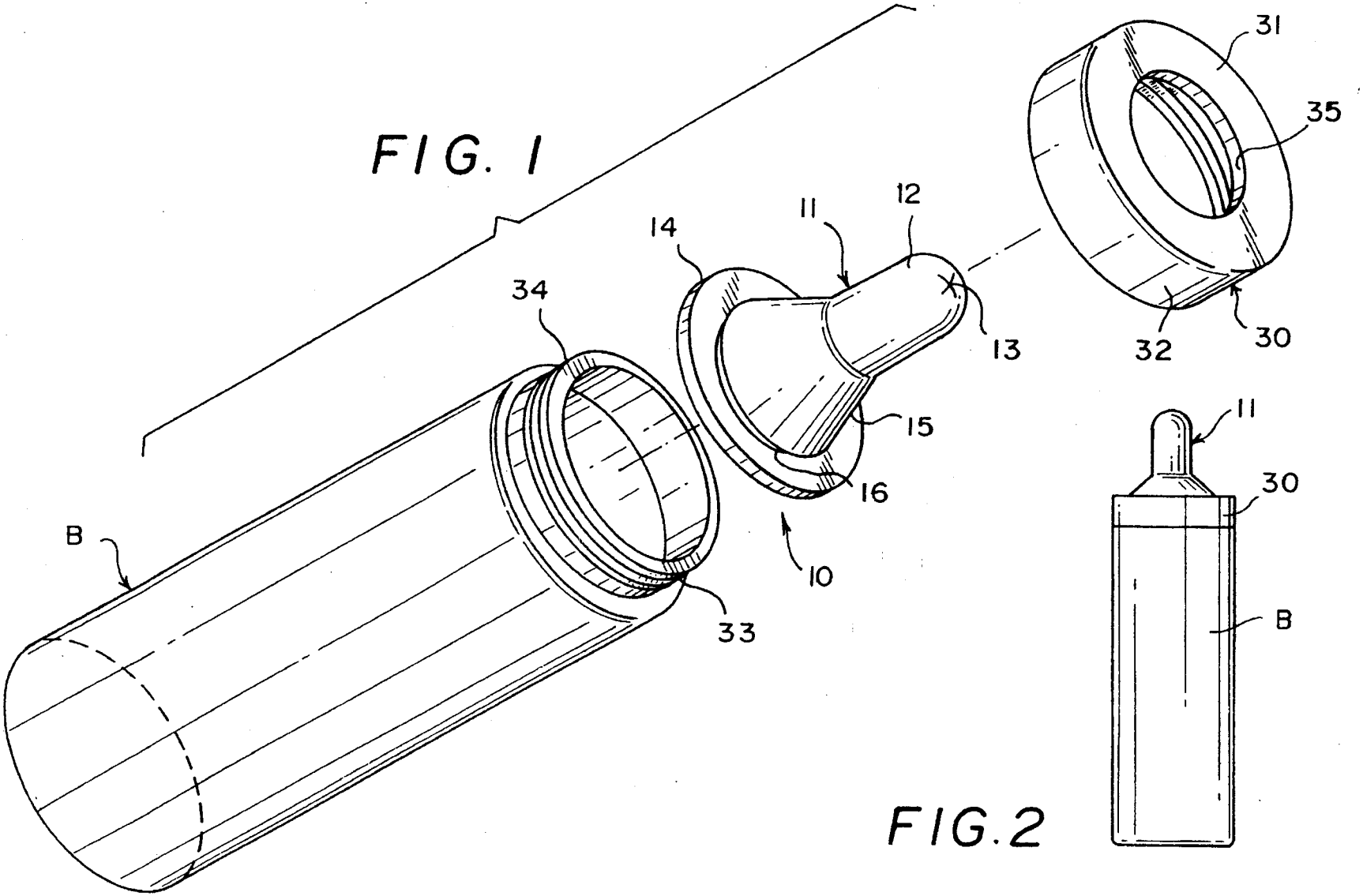
FIG. 1 is an exploded, top perspective view of a preferred form of infant-feeding nipple system of the invention, showing how the nipple may be attached directly to a bottle.
FIG. 2 is a side view in elevation of the nipple and bottle of FIG. 1.

Referring more specifically to the drawings, a preferred form of nipple in accordance with the invention is indicated generally at 10 in FIGS. 1 through 9. The nipple is made of a flexible, elastomeric material of a type commonly employed in the manufacture of infant-feeding nipples, e.g., silicone rubber, and comprises a hollow, tubular body 11 having a tip end 12 with a pair of normally closed crossed slits 13 formed therein, and a radially enlarged flange 14 on its base end.

The thickness of the body is increased toward its base end, defining an outwardly flared portion 15 terminating at the flange 14. An undercut recess 16 is formed in the body between the bottom of the outwardly flared portion 15 and the flange 14 for a purpose described hereinafter.

Figure 5:
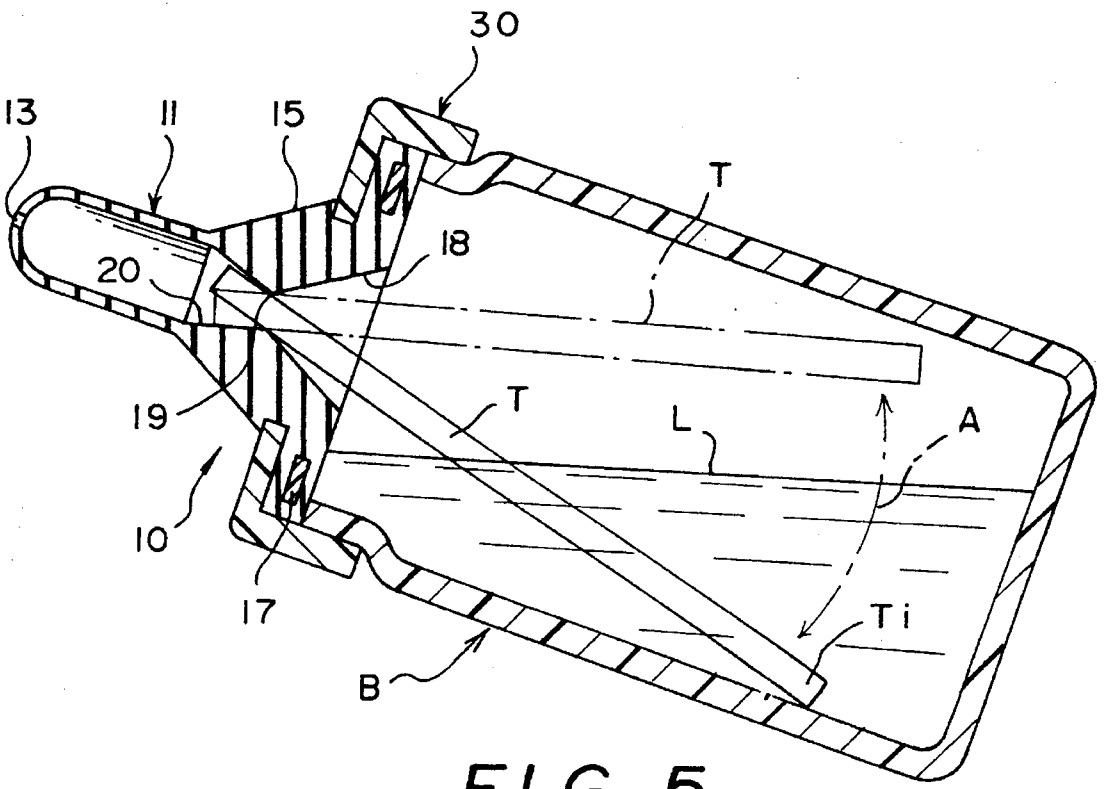
FIG. 5 is a longitudinal sectional view of the nipple and bottle of FIG. 1, showing how the conduit may be inserted into the base end of the nipple and depicting how the conduit is enabled to swing to the lowest position in the bottle so that it remains immersed in the liquid.
Figure 4:
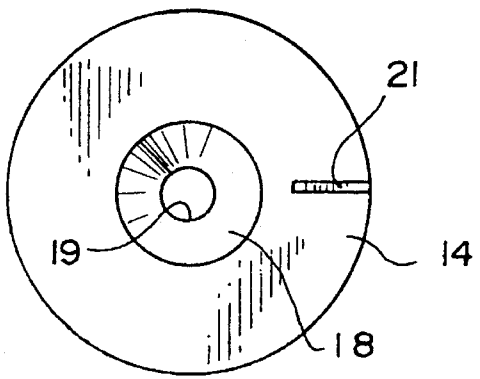
FIG. 4 is an end view in elevation of the base end of the nipple of FIG. 3.
Figure 3:
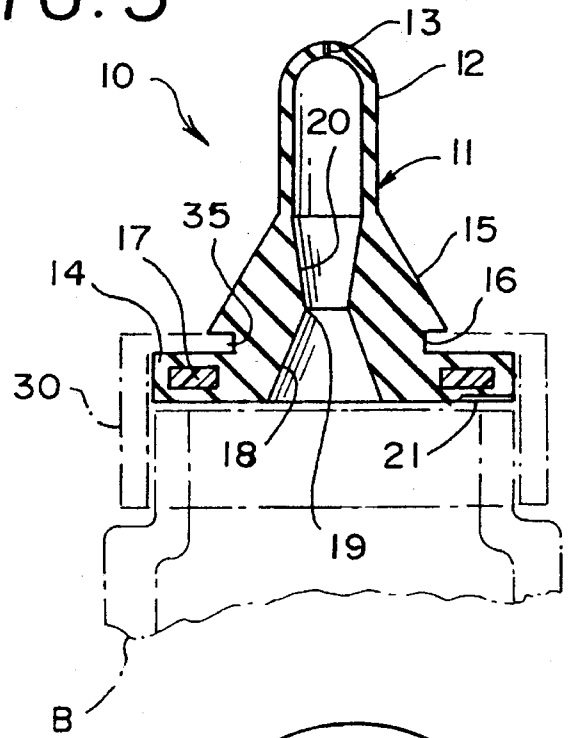
FIG. 3 is a longitudinal sectional view of the nipple of FIG. 1, showing a bottle and attaching ring in dot-and-dash lines.

As seen best in FIGS. 3 and 5, a rigid ring 17 is molded into the flange 14 to rigidify the flange and provide an enlarged diameter ring to prevent an infant from swallowing the nipple. The ring 17 may be made of nylon or other suitable rigid material, and is completely surrounded by the relatively soft material of the nipple 10, whereby a leak-tight seal can be effected between the nipple and a container B on which the nipple may be secured.

The inner diameter of the thickened base of the body portion tapers inwardly at 18 from the base end to a reduced diameter throat 19 and then flares outwardly again at 20 to the inner diameter of the relatively thin-walled nipple tip end portion 12. The reduced diameter, constricted throat portion 19 is adapted to receive therein one end of an elongate tube T (see FIG. 5) in close fitting, sliding, sealed relationship. The compressibility or flexibility of the material of the nipple in the thickened body portion, and the tapered openings 18 and 20, enable tubes of different diameter to be inserted into the reduced diameter throat portion 19. As used herein, tube is meant to include any tubular conduit, such as a straw, or length of flexible tubing, and includes any diameter tube that can be inserted into the base end of the nipple.

The crossed slits 13 are constructed to completely close when sucking action on the nipple is terminated, forming a check valve to prevent reverse flow of air into the nipple. This prevents the liquid from draining from the nipple when the infant stops sucking and the container is lower than the nipple.

A vent slot 21 is formed through the underside of the flange 14 and extends from the outer periphery thereof to an inner end spaced from the opening 18 through the base of the nipple. This vent slot 21 enables air to flow into the container as liquid is drawn from it, thereby preventing a vacuum from forming in the container, without affecting the function of the check valve.

The nipple may be secured to the container B by use of a retaining ring 30 having an end wall 31 and a depending, internally threaded skirt 32 which attaches to external threads 33 on the neck 34 of container B. An opening 35 is formed through the end wall 31, and the inner marginal edge of the end wall surrounding this opening is received in the recess 16 in the base end of the nipple to securely hold the nipple assembled to the end of the container B as illustrated in FIGS. 3 and 5.

With reference to FIG. 5, the tapered openings 18 and 20 permit the tube T to move through an arc A when the container B is inclined, so that the inlet end "Ti" of the tube is enabled to follow the lowest point of the bottle and thereby remain immersed in the liquid L held in the container.

Figure 7:
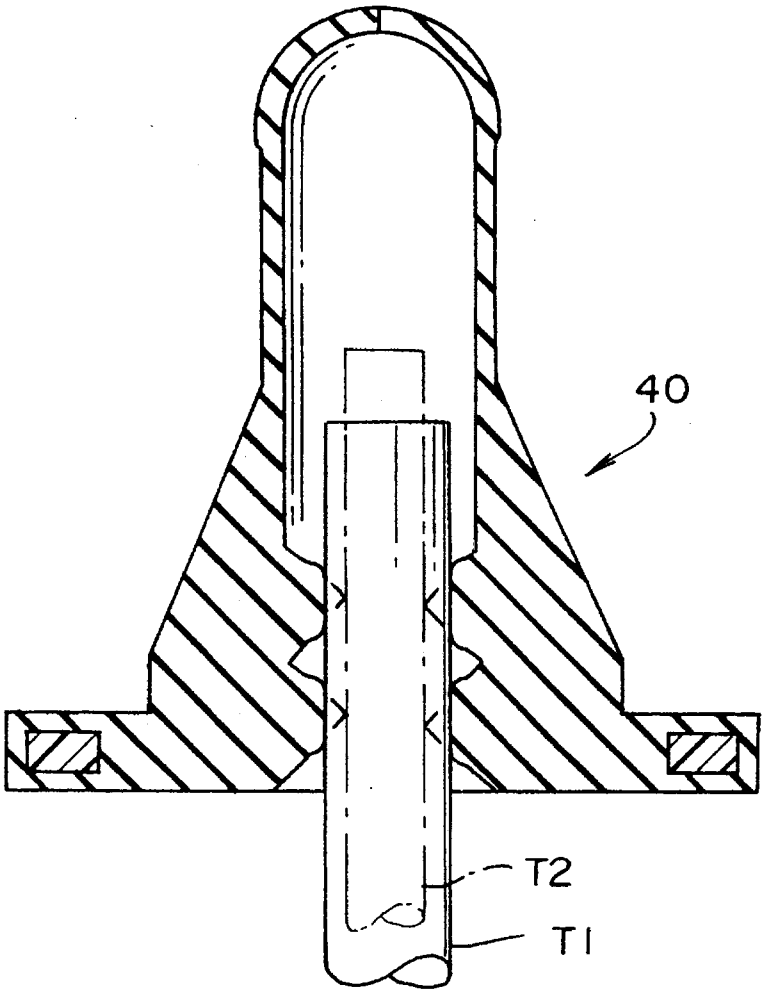
FIG. 7 is a longitudinal sectional view similar to FIG. 6, showing how the shaped inner diameter of the base end of the nipple of FIG. 6 can accomodate and hold different diameter conduits.
Figure 6:
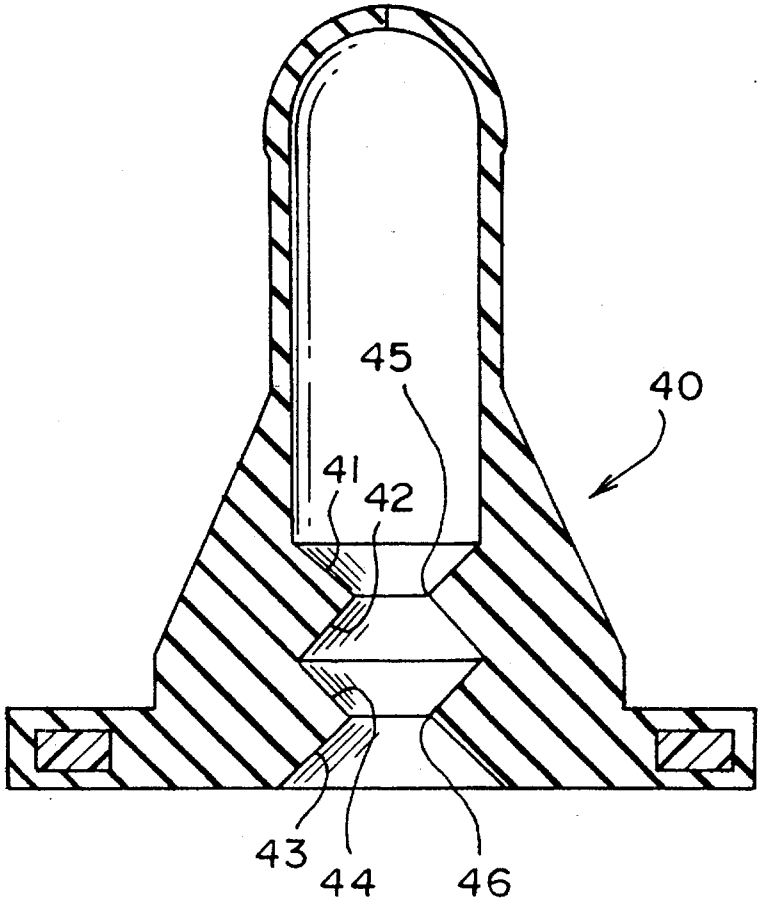
FIG. 6 is an enlarged, longitudinal sectional view of a second form of the nipple, wherein the inner diameter of the base end of the nipple has multiple ribs formed therein to facilitate receiving and holding conduits of different diameter with a sliding seal.

A second form of nipple in accordance with the invention is indicated generally at 40 in FIGS. 6 and 7. This form of the invention is essentially the same as that shown in FIGS.

3–5, except that rather than a single set of tapered surfaces defining a single reduced diameter throat as in FIG. 3, multiple sets of tapered surfaces 41,42 and 43,44 define multiple reduced diameter throats 45 and 46, in effect forming a serrated inner surface in the opening through the base end of the nipple. This serrated inner surface makes an effective sliding seal with tubular conduits having different diameters, as schematically shown in FIG. 7 at T1 and T2, respectively.

Figure 8:
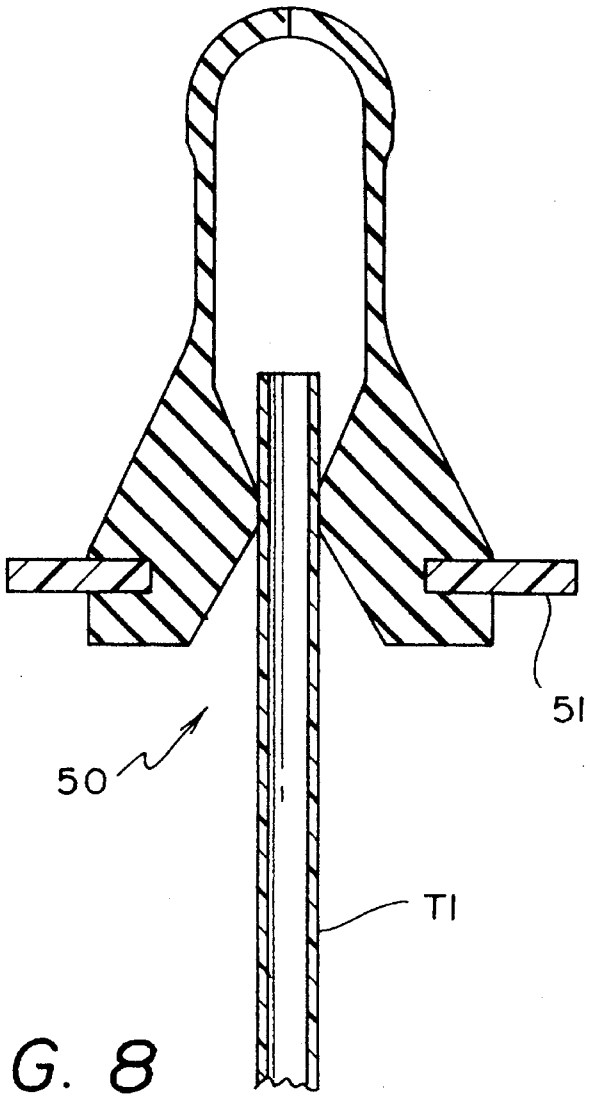
FIG. 8 is a longitudinal sectional view similar to FIG. 7, of a third form of the nipple of the invention, wherein a single reduced diameter throat section is formed through the base end of the nipple, as in that form of the invention shown in FIG. 3, and a separate annular ring is attached to the base end of the nipple, rather than the embedded ring of FIG. 3.
Figure 9:
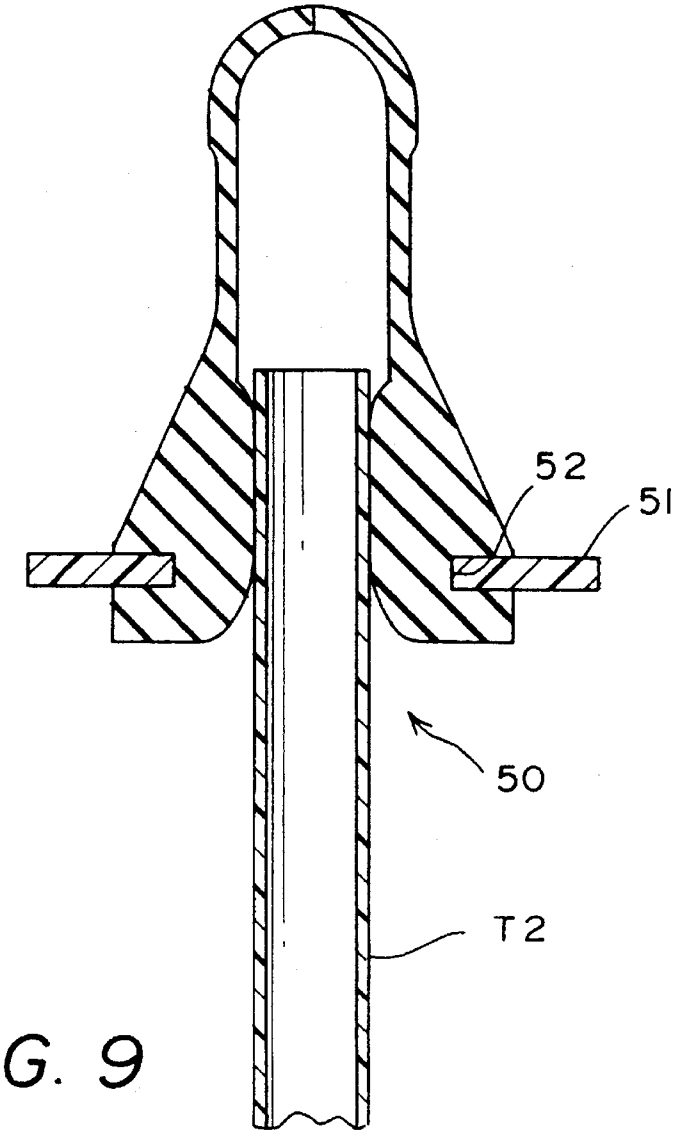
FIG. 9 is a longitudinal sectional view of the nipple of FIG. 8, depicting how the soft rubber material of the nipple is compressed and deformed to receive larger diameter conduits therein.

A third form of nipple according to the invention is indicated generally at 50 in FIGS. 8 and 9. This form of the invention is essentially the same as that shown in FIGS. 3 and 5, except that rather than having an integral diametrically enlarged flange on the base end, with a rigid reinforcing ring embedded therein, a separate rigid annular ring 51 is secured in an annular channel 52 in an outer margin of the base end of the nipple. FIG. 8 depicts how a tubular conduit T1 of small diameter may be sealed to the base end of the nipple with a sliding fit, and FIG. 9 shows how a larger diameter conduit T2 may be slidably received in the base end of the nipple, deforming the relatively soft material of the nipple to accommodate the larger diameter conduit.

Figure 10:
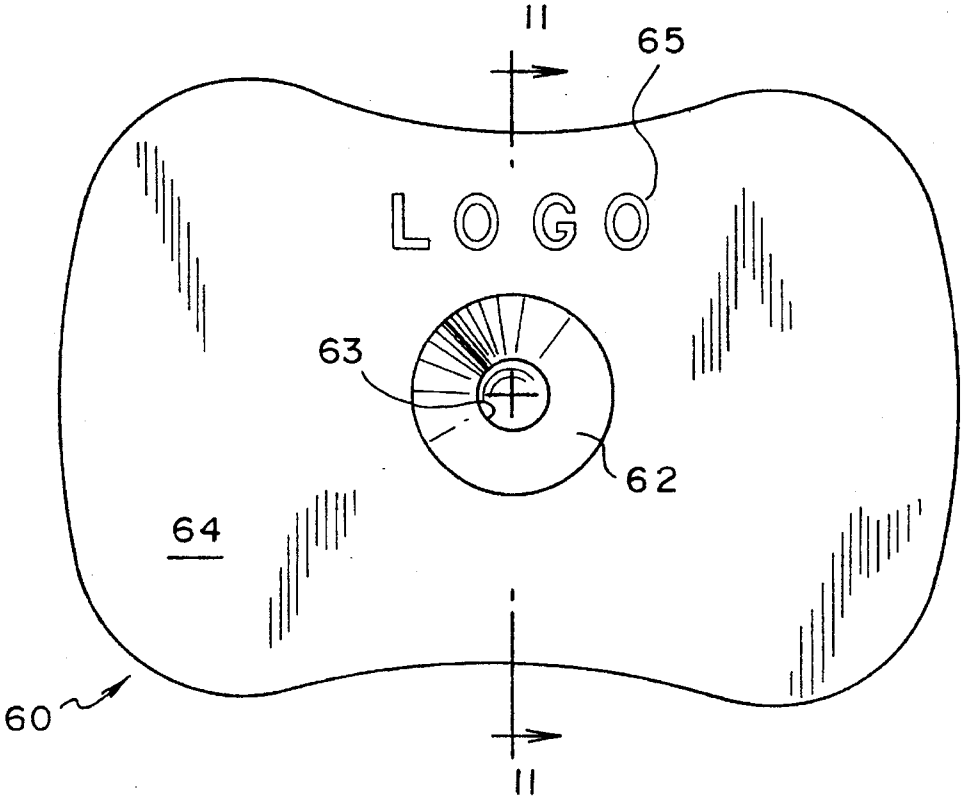
FIG. 10 is a view in elevation looking toward the base end of a fourth form of the nipple of the invention, wherein the base end of the nipple is of sufficient thickness, and has a laterally enlarged flange similar to that found on an infant pacifier, to prevent the nipple from being swallowed by an infant.
Figure 11:
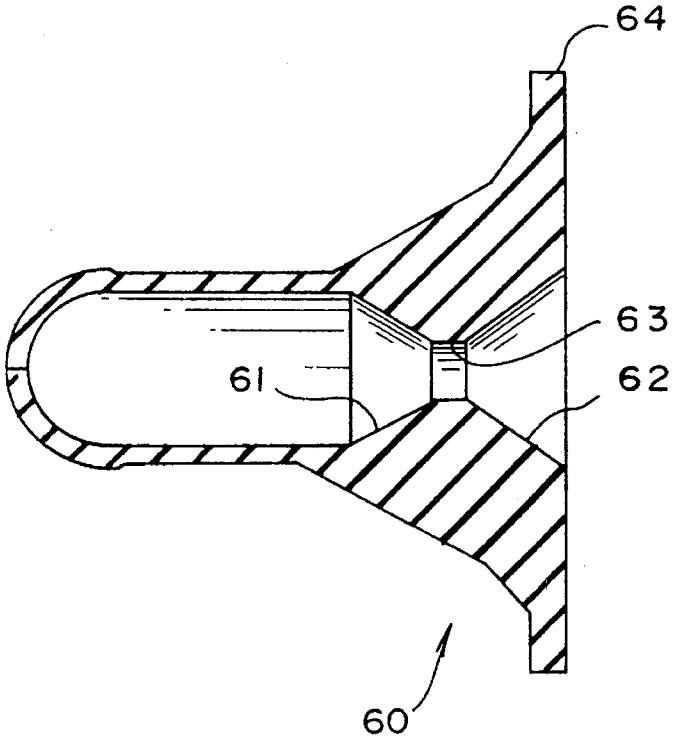
FIG. 11 is a longitudinal sectional view taken along line 11—11 in FIG. 10.

A fourth form of nipple according to the invention is indicated generally at 60 in FIGS. 10 and 11. In this form of the invention, the wall of the base end of the nipple is relatively thick-walled, with a single set of tapered surfaces 61,62 defining a reduced diameter throat 63 for slidably receiving conduits of various diameters therein. A laterally enlarged, bow-tie-shaped flange 64 is formed on the base end, similar to the flange used on infant pacifiers, to provide a gripping surface for the infant and also to prevent the infant from swallowing the nipple. A suitable logo or other message 65 may be placed on the enlarged flange, if desired. This form of the invention may be used in the same way as any of the previously described forms of the invention, except that it cannot be applied directly to a bottle.

FIG. 12 shows a variation of the infant feeding nipple system, wherein a disc-like ring member 70 serves as an adaptor to attach one end of an elongate conduit C to a bottle, with one of the nipples (10, 40, 50 or 60) as previously described attached to the other end of the conduit, so that the bottle may be located remote from the infant. The ring member 70 has a flat, annular flange 71 which is adapted to be clamped between the end 72 of a bottle B and an attaching ring 73, and a conically shaped depression 74 in its center, with either slits 75 (FIG. 13) or a small opening 76 (FIG. 12) for receiving a conduit therethrough. Thus, when the ring member 70 as assembled to a bottle, a conduit C may be slid through it to attach the conduit to the bottle with a sliding seal.

Figure 15:
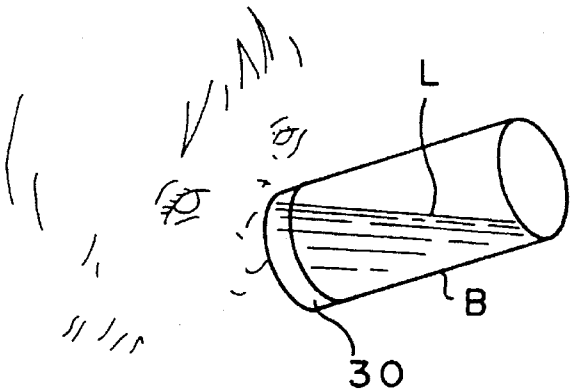
FIG. 15 is a somewhat schematic perspective view showing how any one of the nipples of FIGS. 1–7 can be applied to a bottle and used to feed an infant in a conventional way.

FIG. 15 illustrates how any of the nipples of FIGS. 1–7 may be used conventionally on a bottle B, without any tube or conduit attached to the nipple. When used in this way, it is necessary for the container or bottle B to be elevated above the infant's mouth and held in close proximity to the mouth so that the liquid L will flow into the nipple and thence into the mouth of the infant when the infant exerts sucking action on the nipple.

Figure 16:
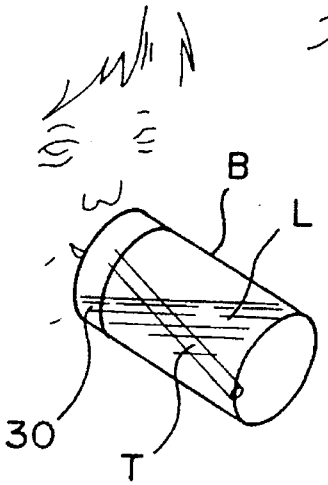
FIG. 16 is a somewhat schematic perspective view showing how any one of the nipples of FIG. 1–7 can be applied to a bottle, with a tube attached to the base end as shown in FIGS. 5 and 7 and extended into the bottle to enable an infant to drink liquid from the bottle even when the bottle is not maintained in an elevated position.
Figure 21:
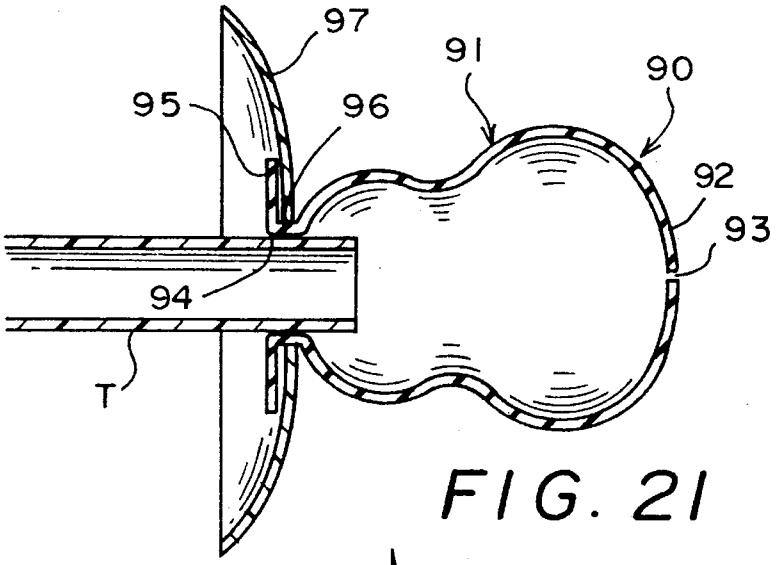
FIG. 21 is longitudinal sectional view of a sixth form of nipple according to the invention, wherein a reduced diameter opening is formed through the base end of the nipple for receiving a conduit therein, and a separate rigid ring member is applied to the base end of the nipple to prevent the infant from swallowing the nipple.

FIG. 16 illustrates how any of the nipples of FIGS. 1–7 may be attached to a bottle B in a conventional manner, with a tube T inserted at one end into the base end of the nipple and extended at its other end into the bottle (see FIG. 5), whereby the bottle El need not be elevated to cause the liquid L to flow into the nipple, but instead, the tube T pivots about its connection with the nipple to follow the lowest point of the container, and thereby remains immersed in the liquid to enable the infant to suck liquid from the container.

Figure 17:
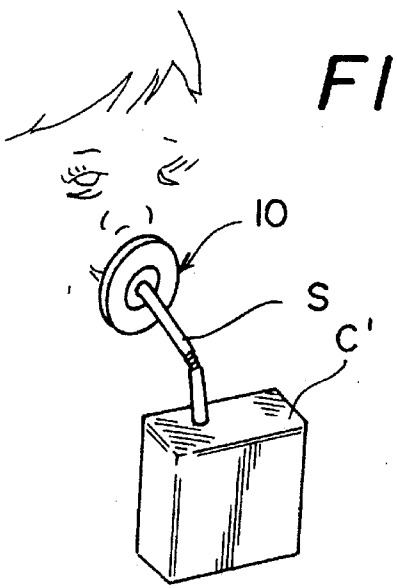

FIG. 17 illustrates still another use of the nipple of the invention, wherein any one of the previously described forms of nipple may be used with a tubular conduit, such as a conventional soda straw or the like S, inserted at one end into the base end of the nipple and inserted at its other end into a carton C' of the type that contains fruit juice or the like, whereby the infant is enabled to drink the liquid from the container C' without having to first transfer the liquid from the carton into a conventional baby bottle or the like. This use of the nipple of the invention is particularly advantageous when the infant has not yet learned to drink without use of a nipple and it is desired to feed the infant from a container other than a conventional baby bottle or the like.

Figure 18:
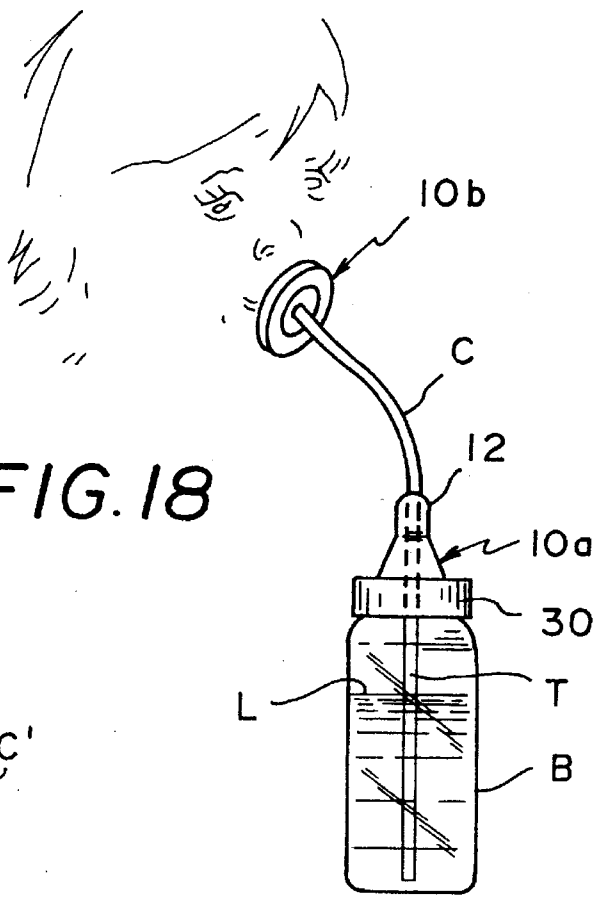
FIG. 18 is a somewhat schematic perspective view showing how any one of the nipples of FIGS. 1–7 may be attached directly to a bottle or other container, and an elongate conduit inserted at one end through the nipple and into a bottle, with its other end extending to a location remote from the bottle and inserted into the base end of any of the nipples of FIGS. 1–12, whereby the infant is enabled to drink liquid from a bottle oriented in an upright position and located remote from the infant's mouth.

A still further use of the nipple system 10 is illustrated in FIG. 18, wherein a first nipple 10*a* is affixed to a bottle B as described above, and a tubular conduit C is inserted at one end through the nipple 10*a* and into the bottle. The other end of the conduit c is inserted into the base end of a second nipple 10*b*, located remote from the bottle. In this way, the infant is enabled to drink liquid L from the bottle B while the bottle remains in an upright position remote from the infant's mouth. If desired, the ring member 70 may be substituted for the first nipple 10*a*.

Figure 19:
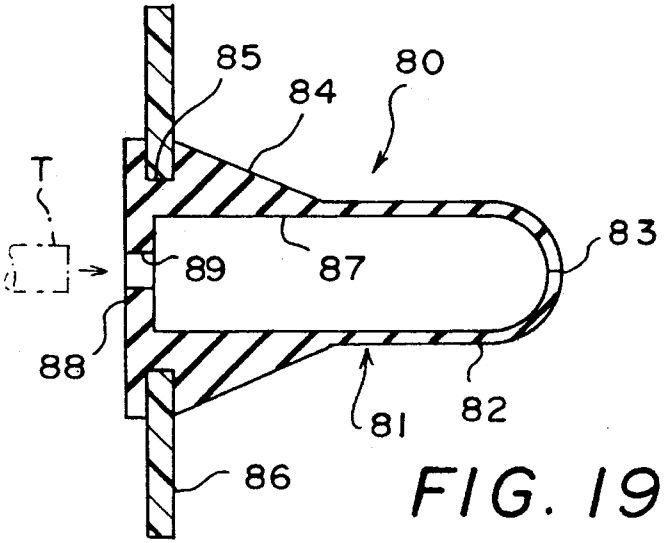
FIG. 19 is a longitudinal sectional view of a fifth form of infant-feeding nipple according to the invention, wherein a separate rigid ring is attached to the base end of the nipple and the nipple has an opening in its base end through which a tube or conduit may be inserted to enable the nipple to be used in a manner such as depicted in FIGS. 15 through 18.
Figure 20:
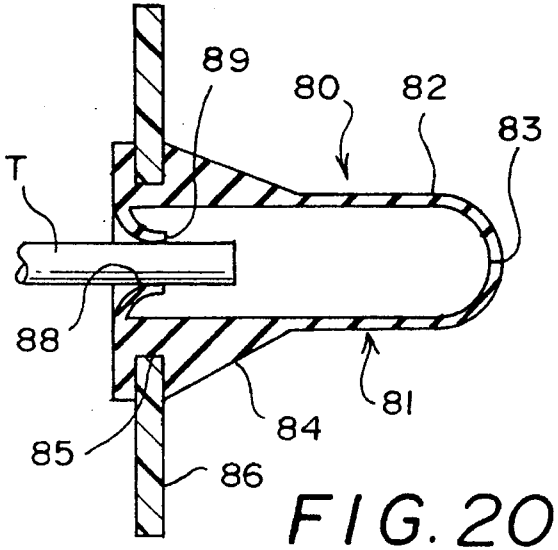
FIG. 20 is a longitudinal sectional view similar to FIG. 19, showing a tube or conduit inserted through the opening in the base end of the nipple, and depicting how the base end of the nipple seals around the conduit during use.
Figure 23:
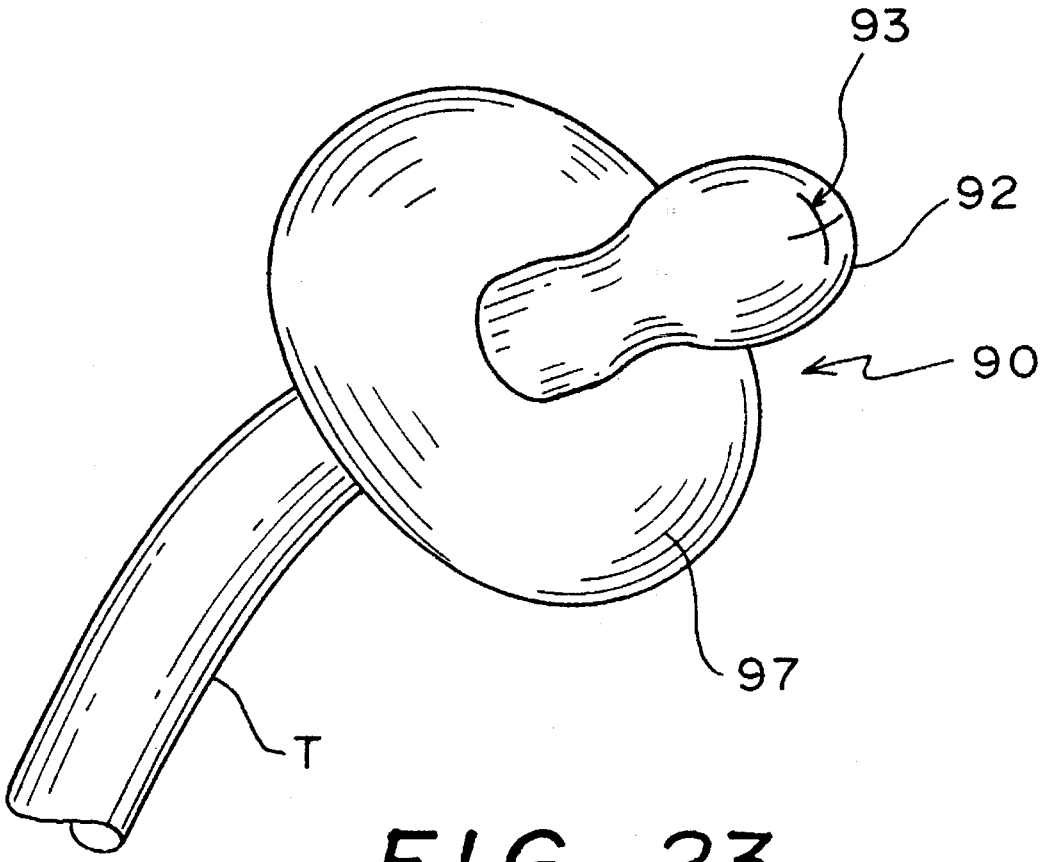
FIG. 23 is a perspective view of the nipple and conduit of FIGS. 21 and 22.
Figure 24:
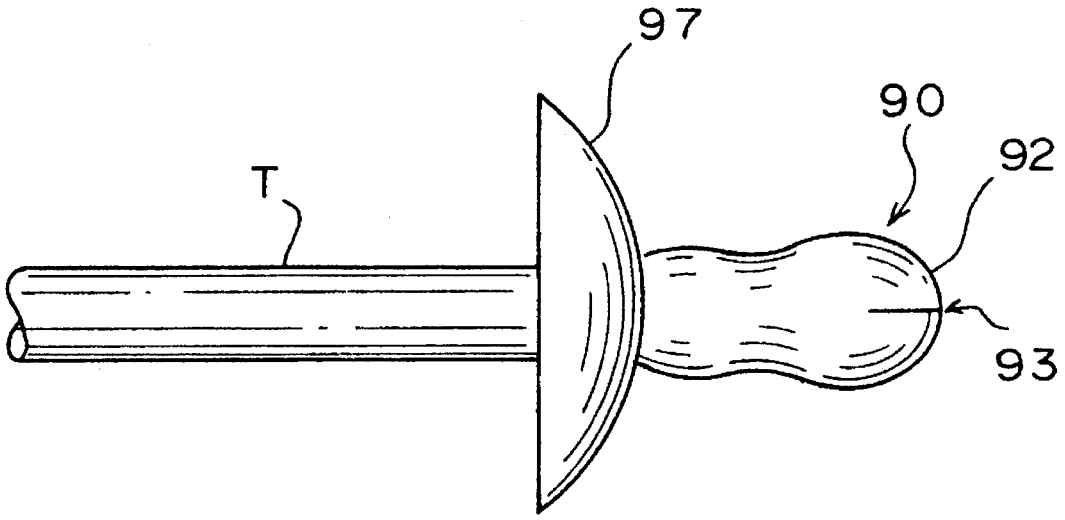
FIG. 24 is a side view in elevation of the nipple and conduit of FIGS. 21 and 22.
Figure 25:
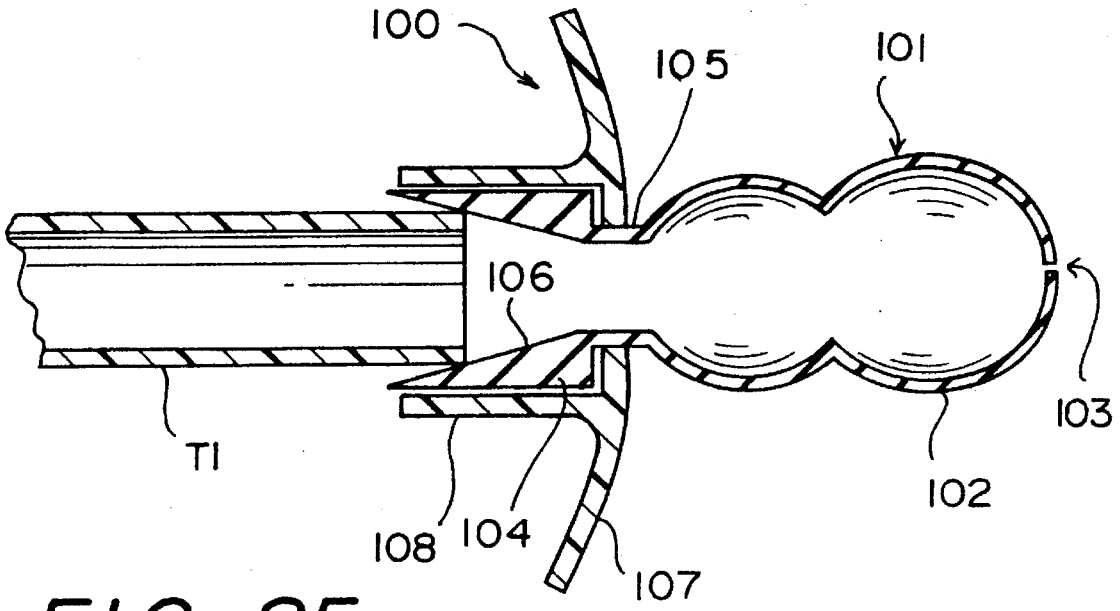
FIG. 25 is a longitudinal sectional view of a seventh form of nipple according to the invention, wherein the base end of the nipple has a tapered diameter opening in it to enable attachment of different diameter conduits, and has a separate ring member secured to the base end of the nipple to reinforce the connection with the conduit and to prevent accidental swallowing of the nipple by the infant.
Figure 26:
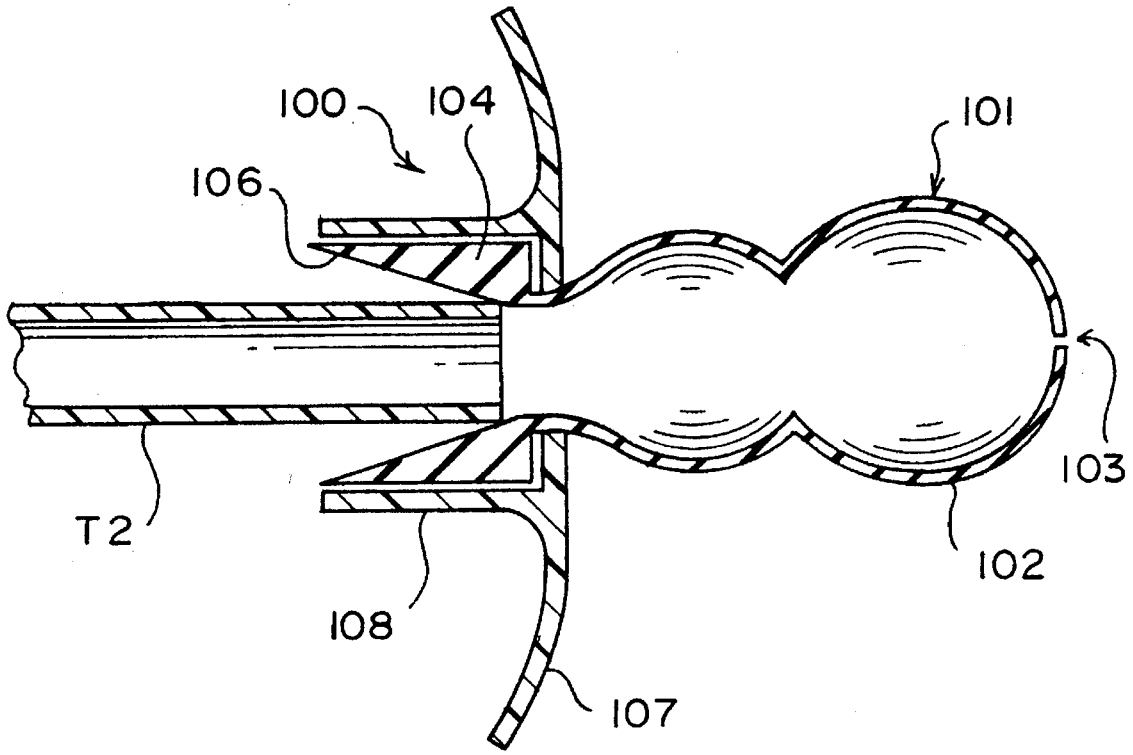
FIG. 26 is a longitudinal sectional view similar to FIG. 25, but showing how a smaller diameter conduit may be attached to the nipple.

A fifth form of nipple according to the invention is indicated generally at 80 in FIGS. 19 and 20. In this form of the invention, the body 81 has a thin walled tip end portion 82 slitted at 83 as in the previous forms of the invention, defining a check valve, and also has a thickened base portion with an outwardly flared side wall 84. A circular recess 85 is formed in the outer surface of the thickened or enlarged diameter base portion, and a rigid annular ring 86 is engaged in the recess 85 to form an enlarged diameter flange that prevents the nipple from being swallowed by an infant. The hollow interior 87 of the nipple is of constant diameter and is closed at its base end by a thin flexible wall 88 that has a central opening 89 to permit insertion of a tube T, as illustrated in FIG. 20. The flexible wall 88 maintains a secure sliding seal with the tube T and enables tubes of different diameters to be inserted into the nipple.

A sixth form of the invention is indicated generally at 90 in FIGS. 21 through 24. In this form of the invention, the body 91 of the nipple is thin-walled throughout and has an enlarged bulbous tip end 92 with crossed slits 93 formed through the end thereof, defining an outlet through which liquid may be drawn by an infant, and which forms a check valve to prevent ingress of air into the nipple when sucking action by the infant is terminated. The base end of the nipple has a reduced diameter opening 94 therethrough for receiving the end of a tube T, and the base end of the nipple is defined by a radially enlarged, outwardly directed flange 95 which, with the adjacent portion of body 91, defines an annular recess 96 in which a diametrically enlarged rigid ring 97 is secured. The ring 97 serves to prevent the nipple from being swallowed by an infant, and also serves to reinforce the base end of the nipple and maintain a secure sliding contact with the tube T.

Figure 22:
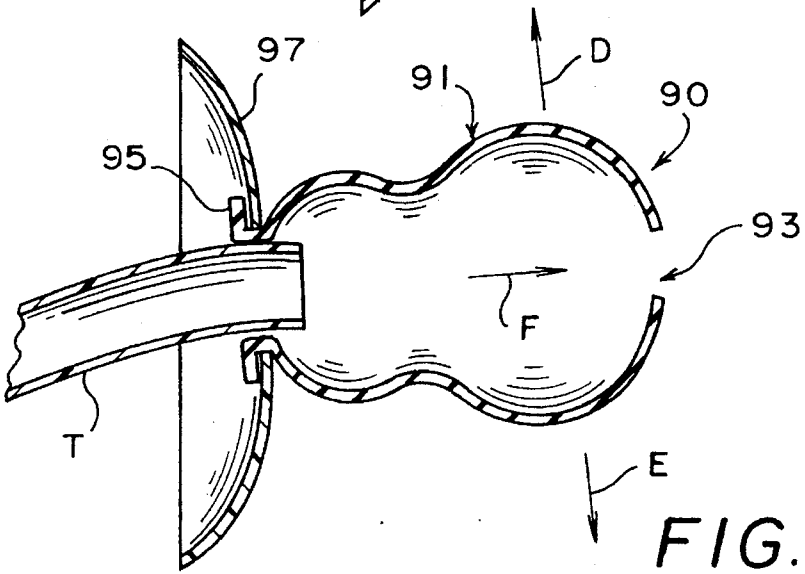
FIG. 22 is a longitudinal sectional view of the nipple of FIG. 21, showing how the slitted check valve opening in the tip end of the nipple is opened to enable outward flow of liquid when the infant applies sucking action to the nipple.

FIG. 22 depicts how the slitted end 93 of the nipple is opened when the infant applies sucking action and lateral pressure to the nipple, which causes the bulbous end to expand outwardly as indicated by the arrows D and E, whereby flow can occur outwardly through the slitted end as indicated by the arrow F. When sucking action and lateral pressure are relieved, the slitted end 93 closes, forming a check valve and preventing ingress of air into the nipple. It should be understood that the crossed slits in all forms of the invention described herein can function in a similar way, or different types of opening means may be used as the check valve.

A seventh form of the nipple is indicated generally at 100 in FIGS. 25 through 28. The nipple according to this form of the invention is similar to that illustrated in FIGS. 21 through 24, in that it has a thin-walled flexible body 101 with an enlarged diameter bulbous end 102 with crossed slits 103 in the tip end thereof defining an outlet for flow of liquid when the infant sucks on the nipple, and which close to form a check valve and prevent ingress of air into the nipple when the infant ceases sucking. However, rather than the radially outwardly extending flange 95 of the embodiment of FIG. 21, the base end 104 of this form of nipple is elongated and diametrically enlarged to define a thickened side wall with a constant outer diameter. An annular channel or recess 105 is formed in the outer surface of the nipple body at the juncture between the base end portion 104 and the bulbous body 101. The inner diameter of the base end portion is outwardly tapered at 106 so that tubes T1 (FIG. 16) and T2 (FIG. 17) of different diameters may be inserted into the opening.

A rigid annular ring 107 has its inner marginal edge received in the recess 105, and includes an axial cylindrical wall 108 which extends in concentric relationship with the enlarged base end portion 104 of the nipple, defining a means to prevent the infant from swallowing the nipple, and also forming a reinforcement for the base end so that the tube T1 or T2 will be securely held therein.

Figure 27:
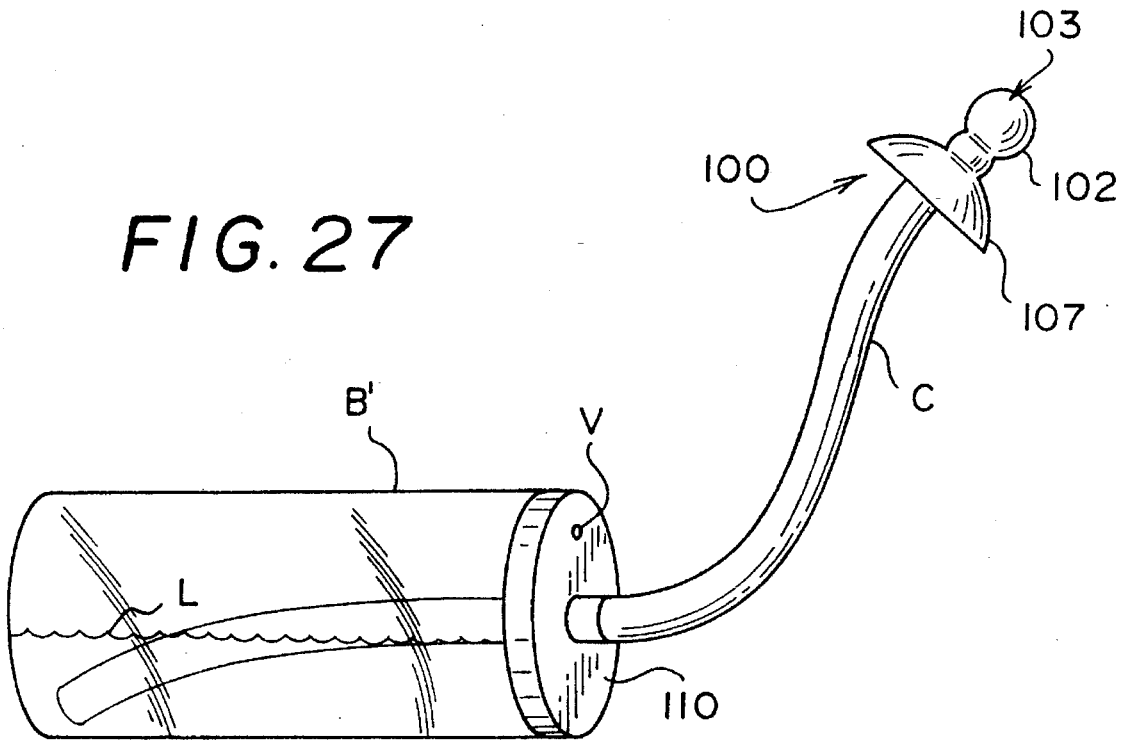
FIG. 27 is a perspective view of the nipple and conduit systems of FIGS. 25 and 26, shown with the conduit attached to a container and depicting how the nipple system may be used to drink liquid from the container even though the container is not maintained in an elevated position.

FIG. 27 shows one way in which the nipple 100 may be used to supply liquid L from a bottle B' to an infant. In this arrangement, an elongate flexible conduit "c" is attached to the nipple 100 at one end and is extended through a special adapter or closure 110 secured over the end of the bottle B'. A suitable vent opening "v" may be provided in the closure 110 to prevent a vacuum from forming in the bottle as liquid is withdrawn therefrom.

Figure 28:
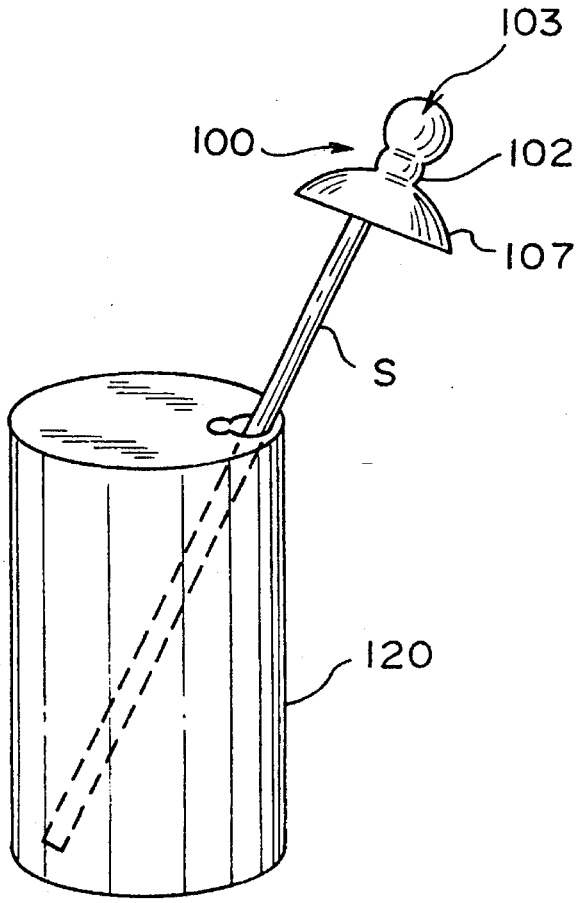

FIG. 28 shows another use of the nipple 100, wherein a conventional soda straw "s" or the like is attached to the nipple and inserted into the opening in a beverage can or the like 120.

While particular embodiments of the invention have been illustrated and described in detail herein, it should be understood that various changes and modifications may be made to the invention without departing from the spirit and intent of the invention as defined by the scope of the appended claims.

What is claimed is:

1. An infant-feeding nipple system comprising:

a flexible elastomeric nipple body having a hollow interior, a tip end, and a base end, and a longitudinal axis extending through the body from the base end through the tip end;

said base end having a reduced diameter opening extending longitudinally therethrough, defining means which is elastomerically yieldable for effecting a sliding seal with an end of a tubular conduit inserted longitudinally into the base end, whereby the nipple may be attached to one end of a conduit that can be extended at its other end into a source of liquid so that an infant can use the nipple and conduit to drink liquid from a source remote from the infant, said elastomerically yieldable mean enabling conduits of different diameters to be selectively slidably sealed to the nipple;

said tip end having normally closed opening means therethrough that opens in response to sucking action on the nipple to enable flow of liquid from a source of the liquid outwardly from the nipple through the opening means, and that closes when sucking action thereon ceases, thereby defining a one-way check valve that prevents ingress of air into the nipple through the opening means; and the diameter of the conduit received in the base end of the nipple being related to the flexibility of the nipple and to the size of the opening means such that the opening means remains closed and the liquid does not drain from the nipple and conduit back into the container when sucking action is terminated and the nipple is at a higher elevation than the liquid in the container, thereby maintaining liquid primed in the conduit and nipple and preventing ingestion of air by an infant when sucking action on the nipple by the infant is stopped and then resumed.

2. An infant-feeding nipple system as claimed in claim 1, wherein:

the nipple body comprises a thin-walled structure having substantially a constant wall thickness throughout, with a radially outwardly extending flange on the base end, said flange defining with the bulbous body an annular recess; and a rigid annular ring engaged in the recess and projecting radially outwardly a substantial distance beyond the flange and the diameter of the bulbous body, defining a safety means to prevent an infant from accidentally swallowing the nipple, and also defining a reinforcement means for maintaining a secure sliding seal with a conduit inserted through the reduced diameter opening in the base end.

3. An infant-feeding nipple system as claimed in claim 1, wherein:

the nipple body comprises a tubular structure having a substantially constant internal diameter, and a thin-walled intermediate portion and tip end, and an increased thickness base end portion with an exterior surface tapering outwardly toward the base end;

an annular channel is formed in the exterior surface of the thickened wall portion at the base end of the nipple body; and the base end of the body is closed by a relatively thin, flexible wall having opening means formed through the center thereof, whereby a tubular conduit may be inserted through the opening means in the flexible wall, deforming the flexible wall and effecting a secure leak-proof sliding seal with the tubular conduit, said flexible wall enabling conduits of different diameters to be slidability received and sealed in said opening means.

4. An infant-feeding nipple system as claimed in claim 1, wherein:

the nipple body comprises a thin-walled bulbous structure having a substantially constant wall thickness;

said base end comprises an axial extension having a substantially constant outer diameter that is radially enlarged relative to the adjoining portion of the bulbous body, defining an annular recess between the base end and the bulbous body, and the reduced diameter opening through the base end tapers outwardly toward the base end, defining a tapered opening adapted to receive tubular conduits of different diameters; and a rigid annular ring is engaged in the recess between the base end and the bulbous body, said ring being diametrically enlarged to form a guard member to prevent an infant from accidentally swallowing the nipple, and a cylindrical axial wall on said ring, extending in coaxial relationship to the base end of the nipple to provide reinforcement to the base end.

5. An infant-feeding nipple system as claimed in claim 1, wherein:

the nipple body has a thin-walled tubular tip end portion and a thick-walled base end portion, said thick-walled base end portion defined by an outwardly tapered exterior wall an d an inwardly tapered interior wall terminating in a reduced diameter throat spaced from the base end of the nipple, and an outwardly tapered interior wall extending from the throat to the base en of the nipple;

a radially enlarged annular flange on the base end of the nipple, defining with the outwardly tapered exterior wall an annular recess; and a rigid annular ring embedded in the flange to rigidify the flange and form a guard member to prevent an infant from accidentally swallowing the nipple.

6. An infant-feeding nipple system as claimed in claim 5, wherein:

the recess in the nipple is adapted to receive an annular clamping ring, and the diametrically enlarged flange on the base end of the nipple is adapted to overly the open end of a container, whereby the nipple may be secured directly on the open end of a container by clamping the flange between the open end of the container and the securing ring.

7. An infant-feeding nipple system as claimed in claim 6, wherein:

an elongate tube is inserted at one end through the reduced diameter throat portion in the base end of the nipple, and the other end of the tubular conduit is adapted to extend into a container holding a supply of liquid to be feed to an infant; and said oppositely tapered interior walls on opposite sides of said throat portion providing clearance space to enable said tubular conduit to pivot about its connection with the throat portion, whereby the conduit can follow the lowest portion of the container to thereby insure that the conduit remains immersed in liquid in the container.

8. An infant-feeding nipple system as claimed in claim 5, wherein:

a first nipple is secured on the open end of a container of liquid to be feed to an infant;

an elongate conduit is inserted through the opening means in the tip end of said first nipple and through the nipple into the container on which said first nipple is secured; and a second nipple is attached to the other end of said conduit, whereby an infant is enabled to drink liquid from the container through said conduit and said second nipple.

9. An infant feeding nipple adapted to be connected with a source of liquid and held in the mouth of an infant and sucked on to obtain liquid from the source, wherein:

said nipple has a longitudinal axis extending from a base end to a tip end thereof;

a passage means extends through the tip end of the nipple for flow of liquid from the nipple in response to sucking action on the nipple by an infant, when the nipple is connected with a source of liquid;

a radially enlarged annular flange is on the base end of the nipple; and a rigid reinforcing member is embedded in said annular flange for rigidifying the flange to enhance the secure attachment of the nipple to the open end of a bottle and to prevent swallowing of the nipple when it is detached from a bottle.

10. An infant-feeding nipple as claimed in claim 9, wherein:

said passage means through the tip end of the nipple comprises normally closed slits defining one-way check valve means for flow of liquid from the nipple in response to sucking action on the nipple by an infant, and operable to prevent leakage of liquid from the nipple and ingress of air into the nipple when an infant is not sucking on the nipple, whereby said check valve means prevents ingress of air into the nipple when sucking action on the nipple ceases and the elevation of liquid in the container is lower then the elevation of the tip end of the nipple, so that liquid that has been drawn into the conduit and nipple will not drain therefrom, regardless of the position of the container or elevation of liquid therein relative to the elevation of the nipple, enabling an infant to drink from a container that is in any position relative to the infant and insuring that liquid remains in the nipple and conduit to prevent ingestion of air by the infant at times when nursing is stopped and then restarted.

11. A nipple as claimed in claim 9, wherein:

a radially enlarged flange means is on the base end of the nipple for attaching the nipple to an open end of a bottle and for preventing an infant from swallowing the nipple when the nipple is not attached to a bottle;

a rigid ring insert is embedded in said annular flange to impart rigidity to it; and the opening means in the tip end of the nipple comprises normally closed check valve means which precludes flow of liquid through the nipple unless a sucking action is being exerted thereon, and which prevents ingress of air into the nipple when sucking action ceases.

12. A nipple as claimed in claim 11, wherein:

the opening means in the base end of the nipple for receiving conduits of different diameters comprises a thin flexible wall extending transversely across the base end of the nipple, and having a central opening therethrough for receiving the conduit, said flexible wall yielding to accommodate conduits of different diameter.

13. A flexible nipple for feeding infants, comprising:

a flexible tubular body having a tip end and a base end;

said tip end having opening means therethrough for flow of liquid from the nipple when sucking action is exerted thereon;

said base end having opening means therethrough for receipt of different diameter conduits, whereby the nipple may be used with a variety of conduits having different diameters to enable an infant to drink from a bottle, can, glass or other container;

a radially enlarged flange means on the base end of the nipple for attaching the nipple to an open end of a bottle and for preventing an infant from swallowing the nipple when the nipple is not attached to a bottle; and a rigid insert embedded in said annular flange to impart rigidity to it.

14. A flexible nipple for feeding infants, comprising:

a flexible tubular body having a tip end and a base end;

said tip end having opening means therethrough for flow of liquid from the nipple when sucking action is exerted thereon;

said base end having opening means therethrough for receipt of different diameter conduits, whereby the nipple may be used with a variety of conduits having different diameters to enable an infant to drink from a variety of containers, including a bottle, can, glass or other container; and the opening means in the tip end of the nipple comprises normally closed check valve means which precludes flow of liquid outwardly through the nipple unless a sucking action is being exerted thereon, and which prevents ingress of air into the nipple when sucking action ceases, whereby said check valve means prevents ingress of air into the nipple when sucking action on the nipple ceases and the elevation of liquid in a container to which the nipple is attached is lower then the elevation of the tip end of the nipple, so that liquid that has been drawn into the conduit and nipple will not drain therefrom, regardless of the position of the container or elevation of liquid therein relative to the elevation of the nipple, thus enabling an infant to drink from a container that is in any position relative to the infant and insuring that liquid remains in the nipple and conduit to prevent ingestion of air by the infant at times when nursing is stopped and then restarted.

15. An infant feeding nipple system as claimed in claim 3, wherein:

said opening means comprises normally closed slits in the transverse wall.

16. An infant feeding nipple adapted to be connected with a source of liquid and held in the mouth of an infant and sucked on to obtain liquid from the source, wherein:

said nipple has a longitudinal axis extending from a base end to a tip end thereof;

a passage means extends through the tip end of the nipple for flow of liquid from the nipple in response to sucking action on the nipple by an infant, when the nipple is connected with a source of liquid;

said base end has a reduced diameter opening extending longitudinally therethrough from an outer end to an inner end for attachment of an elongate tubular conduit that is adapted to be received at one end thereof in said opening and adapted to be received at its other end in a container holding said source of liquid;

a radially enlarged annular flange is on the base end of the nipple; and a rigid annular ring is embedded in said annular flange for rigidifying the flange to enhance the secure attachment of the nipple to the open end of a bottle and to prevent swallowing of the nipple when it is detached from a bottle.

17. A feeding system for infants, comprising, in combination:

a flexible nipple having a tip end and a base end, said nipple having a longitudinal axis and a transverse axis, and a transversely extending flange on the base end to prevent swallowing of the nipple by the infant;

said tip end of the nipple having normally closed slits therein defining one-way check valve means for flow of liquid from the nipple in response to sucking action on the nipple by an infant, and operable to prevent leakage of liquid from the nipple and ingress of air into the nipple when an infant is not sucking on the nipple, whereby said check valve means prevents ingress of air into the nipple when sucking action on the nipple ceases and the elevation of liquid in the container is lower then the elevation of the tip end of the nipple, so that liquid that has been drawn into the conduit and nipple will not drain therefrom, regardless of the position of the container or elevation of liquid therein relative to the elevation of the nipple, enabling an infant to drink from a container that is in any position relative to the infant and insuring that liquid remains in the nipple and conduit to prevent ingestion or air by the infant at times when nursing is stopped and then restarted;

said base end of the nipple having a reduced diameter internal opening extending longitudinally therethrough for receiving a tubular conduit to supply liquid to the nipple in response to sucking action on the nipple;

an elongate tubular conduit having a first diameter and having one end removably received in the opening in the base end of the nipple and sealed relative thereto, said conduit having another end adapted to extend into a container of liquid to be supplied through the conduit to the nipple and fed through the nipple to an infant; and said flexible nipple enabling the material thereof surrounding said opening in the base end to yield upon insertion of different diameter conduits therethrough, whereby conduits of different diameter may be slidably received and sealed in said opening.

* * * * *